US012060680B2

(12) United States Patent
Short

(10) Patent No.: US 12,060,680 B2
(45) Date of Patent: Aug. 13, 2024

(54) ACCESSORY FOR DISC REFINER

(71) Applicant: VALMET AB, Sundsvall (SE)

(72) Inventor: Robert Short, Antrim, NH (US)

(73) Assignee: VALMET AB, Sundsvall (SE)

( * ) Notice: Subject to any disclaimer, the term of this patent is extended or adjusted under 35 U.S.C. 154(b) by 231 days.

(21) Appl. No.: 17/894,384

(22) Filed: Aug. 24, 2022

(65) Prior Publication Data

US 2024/0068161 A1 Feb. 29, 2024

(51) Int. Cl.
*D21D 1/30* (2006.01)

(52) U.S. Cl.
CPC ..... *D21D 1/303* (2013.01)

(58) Field of Classification Search
CPC ..... D21D 1/303; D21D 1/30; D21D 1/306; B02C 7/11
See application file for complete search history.

(56) References Cited

U.S. PATENT DOCUMENTS 3,625,441 A * 12/1971 Saltarelli ..... D21D 1/30 241/246
4,083,503 A * 4/1978 Langdon ..... D21D 1/303 241/259.1

FOREIGN PATENT DOCUMENTS

| | | | |
|---|---|---|---|
| CN | 112160970 | A | 1/2021 |
| DE | 20106854 | U1 | 10/2001 |
| DE | 10 2013 201380 | A1 | 7/2014 |
| GB | 930174 | A | 7/1963 |

OTHER PUBLICATIONS

International Search Report and Written Opinion issued Nov. 27, 2023 in connection with PCT Appl. No. PCT/SE2023/050850.

* cited by examiner

*Primary Examiner* — Bobby Yeonjin Kim
(74) *Attorney, Agent, or Firm* — Foley & Lardner LLP

(57) ABSTRACT

A method for updating a disc refiner by at least partly covering notches of a locknut in the disc refiner and an accessory for a disc refiner Said disc refiner comprising a motor and a rotation shaft assembly, wherein said rotation shaft assembly comprises a rotation shaft, which is connecting the motor and a rotor refiner disc of the disc refiner for driving rotation of the rotor refiner disc from the motor, said rotation shaft assembly further comprising at least one bearing, which is provided between a shaft housing and the rotation shaft for allowing rotation of the rotation shaft within the shaft housing, said rotation shaft assembly further comprising at least one ring-shaped locknut, which is encircling the rotation shaft and configured for holding the at least one bearing in place on the rotation shaft, said locknut comprising notches for a tool to grip when attaching the locknut in the rotation shaft assembly, wherein said accessory is configured for being attached to the locknut and comprises at least one covering part configured for at least partly covering said notches of the locknut when attached to the locknut.

4 Claims, 5 Drawing Sheets

ACCESSORY FOR DISC REFINER

TECHNICAL FIELD OF THE INVENTION

The present invention relates to an accessory for a disc refiner and to a method for updating a disc refiner.

BACKGROUND

A commonly used refiner for refining of, e.g., lignocellulosic material comprises two relatively rotating discs between which the material is refined or defibrated. The pair of relatively rotating discs may in particular comprise one rotating disc, referred to as a rotor, and one static disc, referred to as a stator. Alternatively, the pair of relatively rotating discs may comprise two rotating disc which are rotating in opposite directions. A motor is connected to at least one of the discs via a rotating shaft. The rotating shaft is enclosed by a shaft housing. Bearings are provided for allowing rotation of the rotating shaft within the shaft housing. A locknut is provided for holding bearings in place on the shaft. Oil lubrication is provided inside the shaft housing for allowing smooth rotation of the shaft. The shaft rotation, which also is rotating the locknut, causes oil leakage from the shaft housing.

SUMMARY

An object of the invention is to decrease a leakage of oil from the shaft housing of a disc refiner.

This is achieved by an accessory for a disc refiner and by a method for updating a disc refiner according to the independent claims.

According to one aspect of the invention an accessory for a disc refiner is provided, said disc refiner being used for refining lignocellulosic material and comprises at least two refiner discs, whereof at least one is a rotor refiner disc, said disc refiner further comprising a motor and a rotation shaft assembly, wherein said rotation shaft assembly comprises a rotation shaft, which is connecting the motor and the rotor refiner disc for driving rotation of the rotor refiner disc from the motor, said rotation shaft assembly further comprising a shaft housing, which at least partly encloses the rotation shaft, and said rotation shaft assembly further comprising at least one bearing, which is provided between the shaft housing and the rotation shaft for allowing rotation of the rotation shaft within the shaft housing, said rotation shaft assembly further comprising at least one ring shaped locknut, which is encircling the rotation shaft and configured for holding the at least one bearing in place on the rotation shaft, said locknut comprising notches for a tool to grip when attaching the locknut in the rotation shaft assembly, wherein said accessory is configured for being attached to the locknut and comprises at least one covering part configured for at least partly covering said notches of the locknut when attached to the locknut.

According to another aspect of the invention a method is provided for updating such a disc refiner as defined above, said method comprising the step of at least partly covering said notches of the locknut.

Without this invention, the notches in the locknut are acting as paddles when the rotation shaft and locknut is rotating hereby agitating the oil and causing oil leakage. Thanks to the invention, by which the notches in the locknut at least partly are covered, the notches are prevented from acting as paddles and oil agitation and oil leakage will be decreased.

In one embodiment of the invention, the at least one covering part is configured to cover at least parts of an outer periphery of the locknut when attached to the locknut. Hereby the notches are covered from the outer periphery of the locknut.

In one embodiment of the invention the at least one covering part, when attached to the locknut, constitutes a ring-formed cover, which is covering an outer periphery of the locknut.

In one embodiment of the invention, the accessory comprises at least two separate covering parts, each covering part covering at least one notch when attached to the locknut.

In one embodiment of the invention each covering part comprises an attaching flange, which is extending toward a centre, c, of the locknut when the covering part is attached to the locknut, said attaching flange comprising at least one screw hole for allowing attachment of the covering part to the locknut by at least one screw. Hereby the accessory can be easily attached to the locknut.

In one embodiment of the invention, the method step of at least partly covering said notches comprises covering at least parts of an outer periphery of said locknut.

In one embodiment of the invention, the method step of at least partly covering said notches comprises attaching an accessory as defined above to the locknut.

In one embodiment of the invention, attaching the accessory comprises attaching the accessory by at least one screw, which is provided through at least one screw hole provided in an attaching flange of the accessory.

Further embodiments are described in the detailed description and dependent claims.

DETAILED DESCRIPTION OF EMBODIMENTS

Throughout the drawings, the same reference designations are used for similar or corresponding elements. Generally, all terms used herein are to be interpreted according to their ordinary meaning in the relevant technical field, unless a different meaning is clearly given and/or is implied from the context in which it is used. Any feature of any of the embodiments disclosed herein can be applied to any other embodiment, wherever appropriate.

Figure 1:
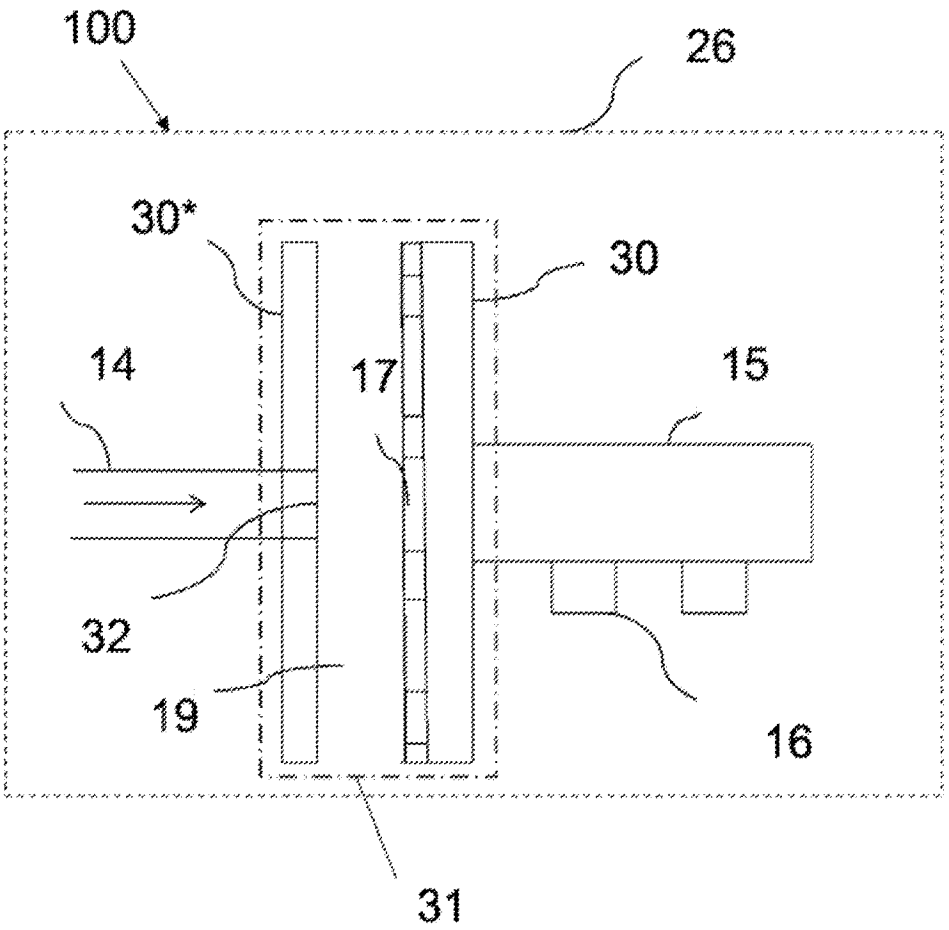
FIG. 1 is a schematic illustration of a disc refiner in which the invention can be used.

For a better understanding of the invention, it may be useful to begin with a brief description of a general disc refiner. To this end reference is made to FIG. 1, which schematically illustrates a disc refiner in which the invention can be used. FIG. 1 shows schematically an exemplary disc refiner 100 in a cross-sectional view. The arrangement is housed in a housing 26 that represents the outer casing of the disc refiner together with all components of the disc refiner that are not essential for understanding the present invention. Examples of components not shown are an electrical motor for driving a rotation shaft 15, the feeding mechanism for the lignocellulosic material, etc. Inside a second housing 31 a rotor refiner disc 30 and a stator refiner disc 30* are linearly aligned along a shaft. The rotor refiner disc 30 is attached to the rotation shaft 15 arranged on bearings 16. The rotation shaft 15 is connected to a motor (not shown) that rotates the rotation shaft 15, and thus the rotor refiner disc 30. The stator refiner disc 30* facing the rotor refiner disc 30 can be provided with a centrally located through hole 32 that extends between a feeding channel 14 for lignocellulosic material and a refining area 19. The feeding of material into the refining area 19 need not necessarily be provided via a centrally located through hole as shown in FIG. 1, but can instead be distributed via through holes distributed in another way than exactly centrally and can also be fed tangentially to the refining area 19. The rotor refiner disc 30 can in certain embodiments be provided with a center plate 17 having a surface facing the incoming flow of lignocellulosic material. The surface of the center plate 17 can be provided with structures that will direct the lignocellulosic material outwards. The rotor refiner disc 30* and/or the stator refiner disc 30 comprises an active surface to enable steering and grinding of the pulp. The active surface comprises often a pattern of bars and dams, which will be described in more detail below. The refiner disc comprises normally a number of refiner segments, each comprising a part of the active surface. The refiner segments can be attached to and removed from the refiner disc and can hereby be exchanged when a pattern on the active surface has been worn out. In some refiners there can be two rotor-refiner discs instead of a rotor and a stator refiner disc, where the two rotor-refiner discs are rotated in opposite directions. The present invention can be applied also in such refiners.

During use, lignocellulosic material, such as wood chips or prepared wood, e.g., pulp, will be fed by means of a feeding mechanism, such as a screw feeder, not shown, into the refining area 19 between the refiner discs. In the example as shown in FIG. 1, the material is fed through the feeding channel 14; there are, however, other types of discs refiners in which this invention can be used as discussed above. In the example as shown in FIG. 1 the material will pass through the hole 32 in the stator refiner disc 30* and enter the area 19. The area 19 is essentially defined by the open area between the rotor 30 and the stator refiner disc 30* and this area can be quite small during operation. The lignocellulosic material flowing into the area 19 will be incident on the center plate 17 on the rotor refiner disc 30. The center plate 17 acts to steer the lignocellulosic material out towards the refiner segments on the rotor and/or stator refiner disc.

A general disc refiner in which the present invention can be used has now been described above in relation to FIG. 1.

Figure 2:
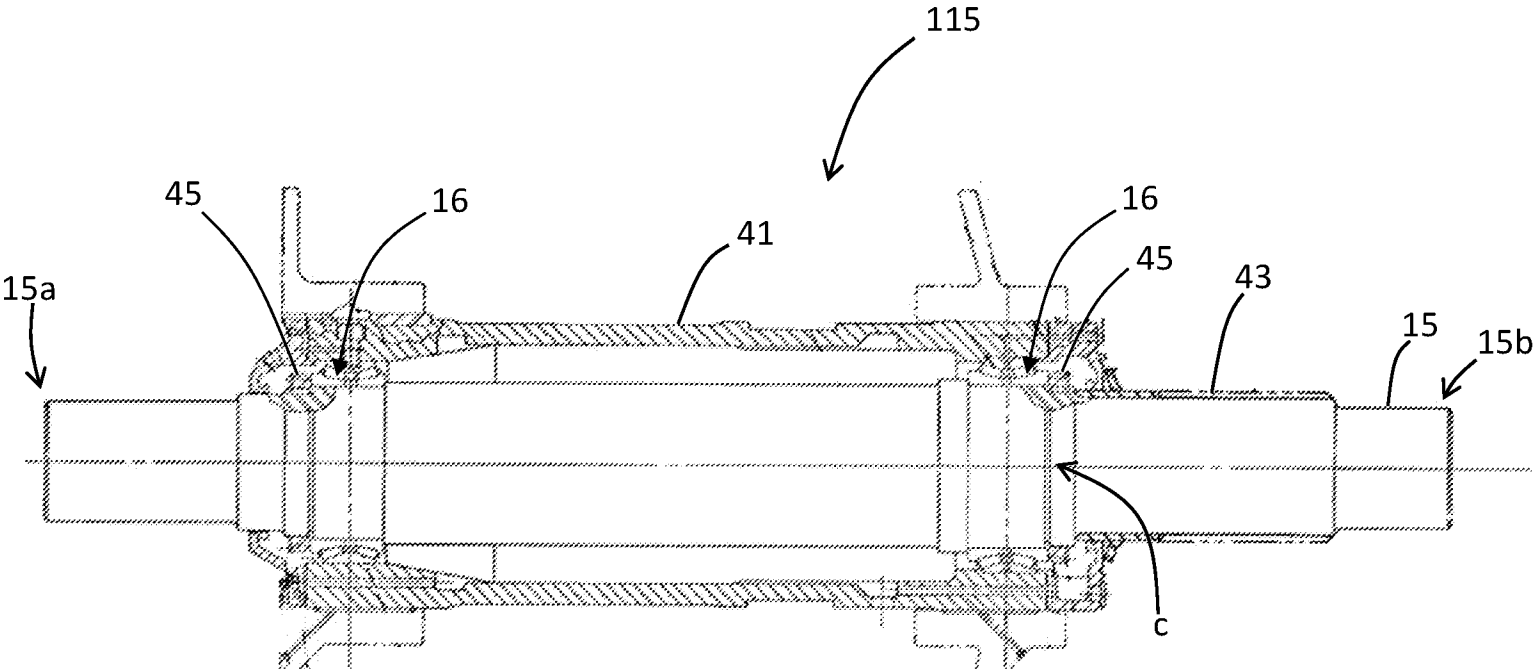
FIG. 2 is a cross section along a length of a rotating shaft which connects a motor with a rotor refiner disc of a disc refiner.

FIG. 2 is a cross section along a length of a rotating shaft assembly 115 comprising a rotating shaft 15, which connects a motor with a rotor refiner disc 30 of a disc refiner 100. The motor is connected to a first end 15*a* of the rotating shaft 15, and the rotor refiner disc 30 is connected to a second end 15*b* of the rotating shaft 15. The rotation shaft 15 connects the motor and the rotor refiner disc 30 for driving rotation of the rotor refiner disc 30 from the motor. The rotation shaft assembly 115 comprises further a shaft housing 41, which surrounds the rotation shaft 15 along at least a part of a length of the rotation shaft 15. Hereby the rotation shaft 15 is at least partly enclosed by the shaft housing 41. The rotation shaft 15 comprises further at least one bearing 16, which is provided between the shaft housing 41 and the rotation shaft 15, for allowing rotation of the rotation shaft 15 within the shaft housing 41. In some examples, at least one bearing 16 is provided in each end of the shaft housing, as shown in FIG. 2. The rotating shaft assembly 115 comprises further at least one ring shaped locknut 45, which is encircling the rotation shaft 15 and configured for holding the at least one bearing 16 in place on the rotation shaft 15. One locknut 45 can be provided for holding a bearing 16 in one end of the shaft housing 41 and another locknut 45 can be provided for holding a bearing 16 in the other end of the shaft housing 41, as shown in FIG. 2. A sleeve 43 is also shown which is surrounding a part of the rotation shaft 15. However, the sleeve is not relevant for the invention, but is provided for wear reasons.

Figure 3A:
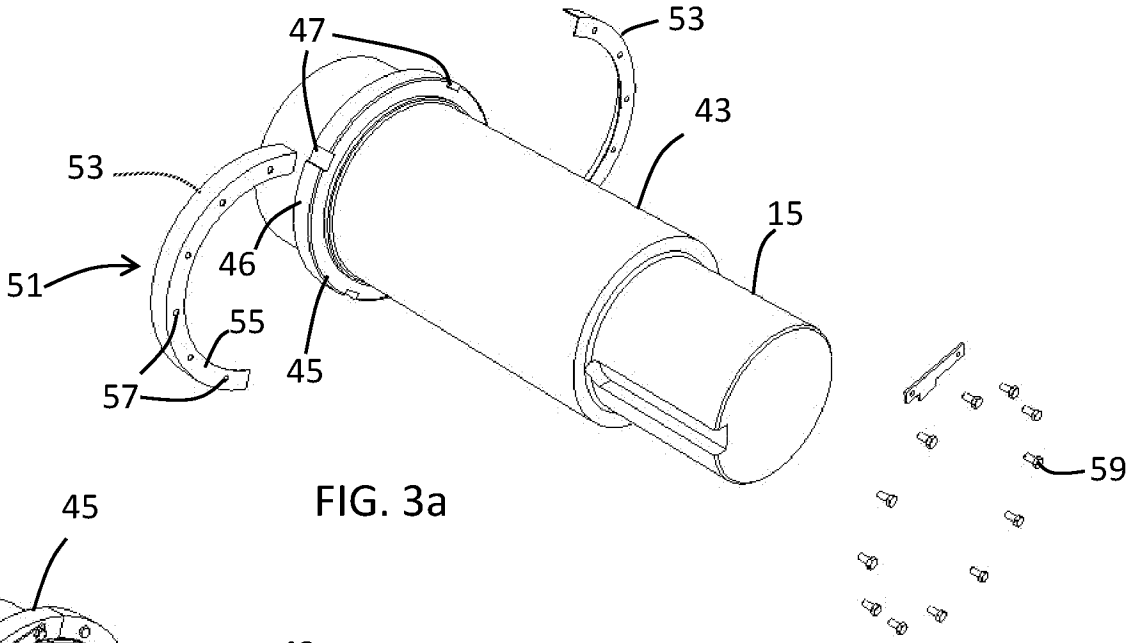
FIG. 3*a* shows schematically an accessory according to one embodiment of the invention to be connected to a locknut which is holding a bearing in place on the rotating shaft.
Figure 3B:
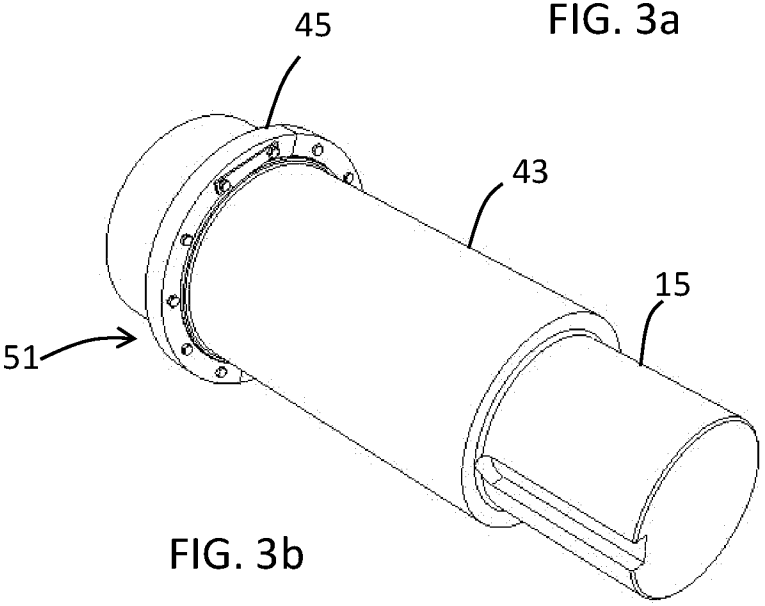
FIG. 3*b* shows the same accessory as shown in FIG. 3*a* when connected to the locknut.
Figure 3C:
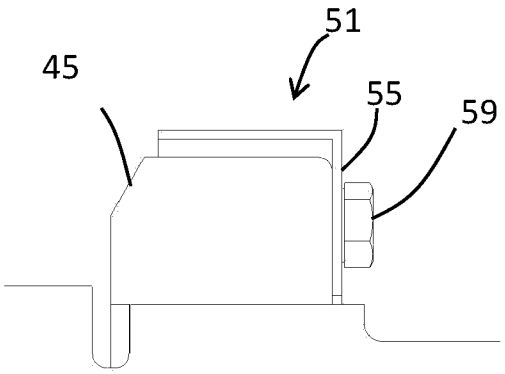
FIG. 3*c* is a cross section of the accessory attached to the locknut as shown in FIG. 3*b*.
Figure 3D:
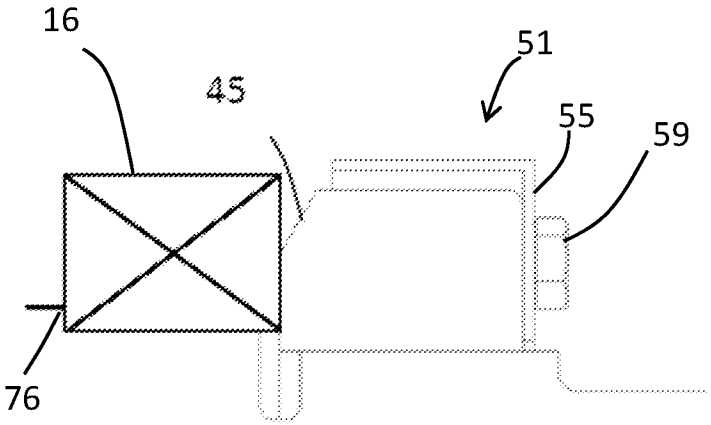
FIG. 3*d* is the same cross section as shown in FIG. 3*c* but with a bearing added for illustration.
Figure 4A:
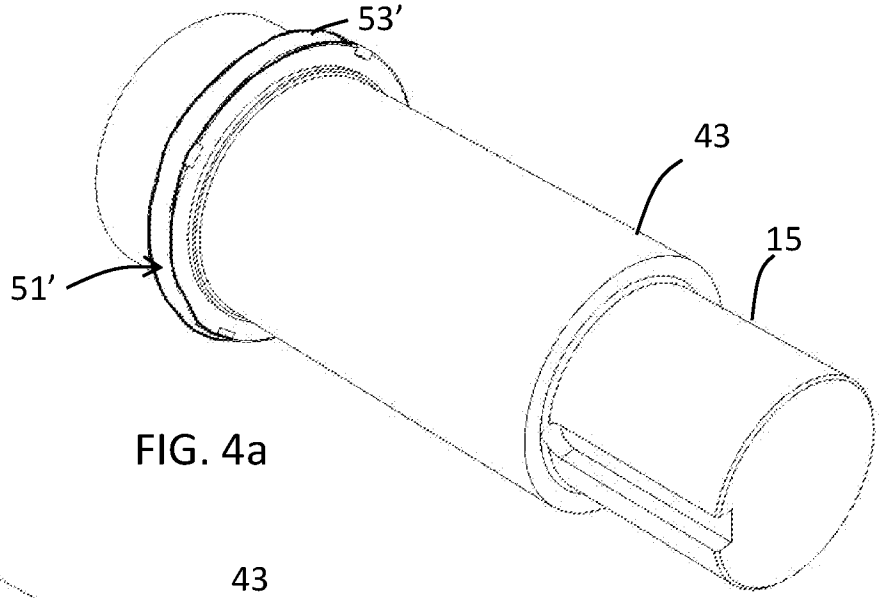
FIG. 4*a* shows schematically an accessory according to one embodiment of the invention when attached to a locknut which is holding a bearing in place on the rotating shaft.
Figure 4B:
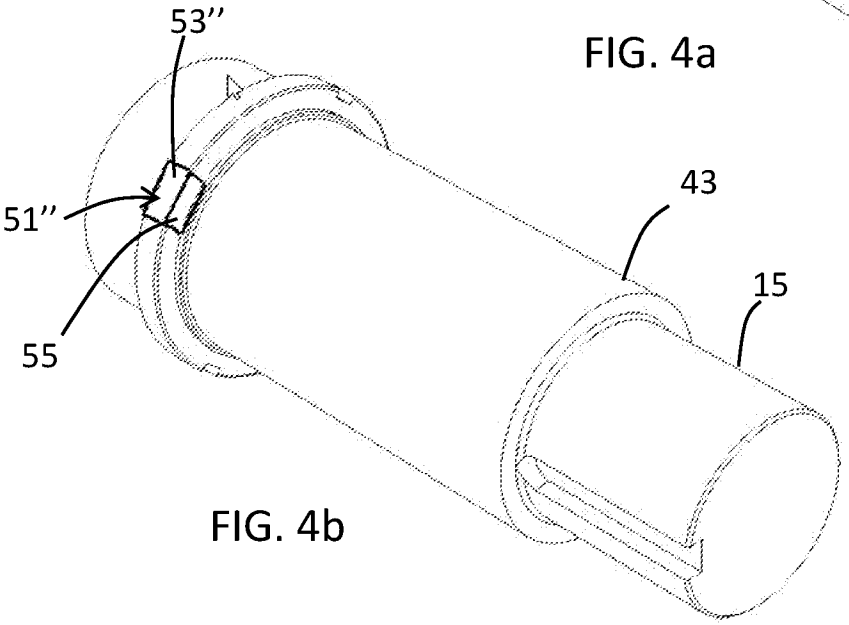
FIG. 4*b* shows schematically an accessory according to another embodiment of the invention when attached to a locknut which is holding a bearing in place on the rotating shaft.

FIG. 3*a* shows schematically an accessory 51 according to one embodiment of the invention to be connected to a locknut 45, which is holding a bearing 16 in place on the rotating shaft 15. The bearing 16 is not shown in this view, which view is only a part of the rotation shaft assembly 115. FIG. 3*b* shows the same accessory 51 as shown in FIG. 3*a* when connected to the locknut 45. FIG. 3*c* is a cross section of the accessory 51 attached to the locknut 45, as shown in FIG. 3*b*. FIG. 3*d* is a cross section of the accessory 51 attached to the locknut 45, as shown in FIG. 3*b* but with a bearing 16 added for illustration. Two other examples of an accessory 51'; 51" according to the invention when connected to a locknut 45 are shown in FIGS. 4*a* and 4*b*.

In FIG. 3*a* it can be seen that the locknut 45 comprises notches 47 for a tool to grip when attaching the locknut 45 in the rotation shaft assembly 115. According to the invention oil leakage from the shaft housing 41 can be decreased by covering, or at least partly covering, these notches 47. When the rotation shaft 15 rotates, also the locknut 45 rotates, and without the invention the notches 47 will act as paddles and agitate the oil which is provided inside the shaft housing 41 for allowing smooth rotation of the shaft. By covering the notches 47, the oil will be agitated less and oil leakage from the shaft housing 41 will be decreased. Hereby according to the invention both a method is provided for updating existing disc refiners by covering or at least partly covering said notches 47 of the locknut 45 and an accessory 51; 51'; 51" is provided, which is configured for being attached to the locknut 45 and which comprises at least one covering part 53; 53'; 53" configured for at least partly covering said notches 47 of the locknut 45 when attached to the locknut 45.

The step to at least partly covering said notches 47 can comprise covering at least parts of an outer periphery 46 of said locknut 45.

The step of at least partly covering said notches can also comprise attaching an accessory 51; 51'; 51" according to the invention to the locknut 45.

The at least one covering part 53; 53'; 53" of the accessory 51; 51'; 51" according to the invention is configured to cover at least parts of an outer periphery 46 of the locknut 45 when attached to the locknut 45. Hereby the notches 47 of the locknut 45 will be at least partly covered by the covering part 53; 53'; 53". In some examples, as shown for example in FIGS. 3*a*, 3*b* and 4*a*, the at least one covering part 53; 53'; 53", when attached to the locknut 45, constitutes a ring-formed cover which is covering an outer periphery 46 of the locknut 45. In the example shown in FIGS. 3*a* and 3*b*, the accessory 51 comprises two covering parts 53, which together constitutes a ring-formed cover when attached to the locknut 45, as can be seen in FIG. 3*b*. In the example as shown in FIG. 4*a*, the accessory 51' comprises one covering part 53' which is a ring-formed cover which should be attached around the outer periphery 46 of the locknut 45.

The accessory 51; 51'; 51" according to the invention can in some embodiments comprise at least two separate covering parts 53; 53", wherein each covering part 53; 53" covers at least one notch 47 when attached to the locknut 45.

In the example as shown in FIG. 4*b*, the accessory 51" comprises one separate covering part 53" for each notch 47 (even if only one covering part 53" is shown).

According to some examples, as for example shown in FIGS. 3*a*-3*d* and FIG. 4*b*, each covering part 53; 53" comprises an attaching flange 55, which is extending toward a centre, c, (shown in FIG. 2) of the locknut 45 when the covering part 53; 53" is attached to the locknut 45. Said attaching flange 55 comprises at least one screw hole 57 for allowing attachment of the covering part 53; 53" to the locknut 45 by at least one screw 59.

In FIG. 3*d* it is illustrated how the locknut 45 holds the bearing 16 towards a shoulder 76 of the rotation shaft 15.

In FIGS. 3*a* and 3*b* a locking tab 60 is shown. This is an existing part which is not part of the invention. The locking tab 60 is mounted to the locknut 45 and prevents the locknut 45 from unscrewing by a protruding tab which fits into a slot in the rotation shaft 15.

The invention claimed is:

1. A method for updating a disc refiner for refining lignocellulosic material, the method comprising:

providing the disc refiner, which comprises;

at least two refiner discs, whereof at least one of the two refiner discs is a rotor refiner disc, a motor, and a rotation shaft assembly comprising:

a rotation shaft that connects the motor and the rotor refiner disc for driving rotation of the rotor refiner disc from the motor, a shaft housing that at least partly encloses the rotation shaft, at least one bearing that is provided between the shaft housing and the rotation shaft for allowing rotation of the rotation shaft within the shaft housing, and at least one ring-shaped locknut that encircles the rotation shaft and is configured to hold the at least one bearing in place on the rotation shaft, the locknut comprising notches for a tool to grip when attaching the locknut in the rotation shaft assembly; and at least partly covering the notches of the locknut.

2. The method according to claim 1, wherein the step of at least partly covering the notches comprises covering at least parts of an outer periphery of the locknut.

3. A method for updating a disc refiner for refining lignocellulosic material, the method comprising:

providing the disc refiner, which comprises:

at least two refiner discs, whereof at least one of the two refiner discs is a rotor refiner disc, a motor, and a rotation shaft assembly comprising:

a rotation shaft that connects the motor and the rotor refiner disc for driving rotation of the rotor refiner disc from the motor, a shaft housing that at least partly encloses the rotation shaft, at least one bearing that is provided between the shaft housing and the rotation shaft for allowing rotation of the rotation shaft within the shaft housing, and at least one ring-shaped locknut that encircles the rotation shaft and is configured to hold the at least one bearing in place on the rotation shaft, the locknut comprising notches for a tool to grip when attaching the locknut in the rotation shaft assembly;

providing an accessory configured to be attached to the locknut, the accessory comprising at least one covering part; and attaching the accessory to the locknut such that the at least one covering part of the accessory at least partly covers the notches of the locknut.

4. Method according to claim 3, wherein attaching the accessory comprises attaching the accessory by at least one screw the is provided through at least one screw hole provided in an attaching flange of the accessory.

* * * * *